United States Patent [19]

Lederer

[11] Patent Number: 5,012,816

[45] Date of Patent: May 7, 1991

[54] ELECTRONIC ACUPUNCTURE DEVICE

[76] Inventor: Gabor Lederer, 3 Opal Ct., Pomona, N.Y. 10970

[21] Appl. No.: 401,174

[22] Filed: Aug. 31, 1989

[51] Int. Cl.[5] ..... A61H 39/02

[52] U.S. Cl. ..... 128/735; 128/800; 128/907

[58] Field of Search ..... 128/735, 800, 801, 907

[56] References Cited

U.S. PATENT DOCUMENTS

| | | | |
|---|---|---|---|
| 3,894,532 | 7/1975 | Morey | 128/735 |
| 4,016,870 | 4/1977 | Lock | 128/735 |
| 4,052,978 | 10/1977 | Eugenio | 128/735 |
| 4,112,923 | 9/1978 | Tomecek | 128/735 |
| 4,408,617 | 10/1983 | Auguste | 128/735 |
| 4,556,064 | 12/1985 | Pomeranz et al. | 128/423 R |
| 4,848,357 | 7/1989 | Wong et al. | 128/735 |

FOREIGN PATENT DOCUMENTS

| | | | |
|---|---|---|---|
| 2425847 | 1/1980 | France | 128/735 |
| 2115700 | 9/1983 | United Kingdom | 128/800 |

*Primary Examiner*—William E. Kamm

*Assistant Examiner*—Scott M. Getzow

[57] ABSTRACT

A hand-held, self-operable electronic acupuncture device includes a hand-holdable casing having an outer surface; a probe for supplying current to the skin of a person, the probe extending from the casing and movable with respect to the casing in an axial direction of the probe; a coil spring for biasing the probe out of the casing; a locating current supply for supplying a locating current to the probe; a therapeutic current supply for supplying a therapeutic current to the probe in a tone mode or a relax mode; a switch assembly for selectively supplying the locating current or therapeutic current to the probe; contact members on the outer surface of the casing for completing an electrical circuit of the device when the person is in contact with the contact membrs so as to provide a return path for the locating current and the therapeutic current; and a switch control for controlling the switch assembly to selectively supply the therapeutic current to the probe either directly or indirectly through the contact members and the body of the user.

12 Claims, 3 Drawing Sheets

ELECTRONIC ACUPUNCTURE DEVICE

BACKGROUND OF THE INVENTION

This invention relates generally to acupuncture devices, and more particularly, is directed to a hand-held, self-operable acupuncture device.

The art of acupuncture has been used by the Chinese for nearly 4,500 years to treat and alleviate physical and mental pain. Chinese acupuncture has been based on the principle that complementary forces of Yin and Yang control Qi, the essential energy running through the human body. Specifically, it was believed that there are twelve meridians or channels connected under the skin to all of the basic organs of the body. When pain or bad health occur, it was believed that Qi was out of balance. Acupuncture was designed to restore the balance so that flow through the twelve meridians is established with the proper balance. There are approximately 2,000 points along the meridians at which the acupuncturist can insert needles to redirect the flow to achieve proper balance.

Accordingly, needles were inserted into the desired acupuncture points to achieve balance, the needles being twirled or oscillated about their axes to enhance the effect of the acupuncture. Because the twirling of the needles requires great skill, and because such twirling becomes extremely tiresome after a short period of time, it has been suggested that the manual twirling be replaced by the application of an alternating current to the needles to achieve the same effect. See, for example, U.S. Pat. No. 3,908,669 to Man et al and U.S. Pat. No. 3,897,789 to Blanchard.

Modern medicine indicates that acupuncture may have some benefit, but that acupuncture has nothing to do with vital energy running through the body. Instead, it is argued that acupuncture is merely a good way to stimulate peripheral nerves so that the body's own mechanism for overriding pain is stimulated. Thus, some research has shown that acupuncture releases various neurotransmitters and activates three areas of the nervous system. Specifically, acupuncture stimulates nerves to send mild pain messages to the spinal cord, which in turn releases pain-blocking chemicals. The spinal cord sends impulses to the midbrain which sends other pain-blocking neurotransmitters to the spinal cord. Finally, the spinal cord may stimulate the pituitary gland to release pain blockers and anti-inflammatory agents into the blood stream and brain.

Further, research has now shown that the manner in which acupuncture is applied can vary the effectiveness thereof. Thus, the specific frequency of the AC signal supplied to the needles has proven effective for different pain relief.

As a further development, it has been found that a similar effect can be achieved merely by the application of an AC signal to the skin surface at the desired acupuncture points. In such case, a probe contacts the skin of the user to apply such AC signal. An example of such a system is described in U.S. Pat. No. 4,763,657 to Chen et al, which describes a hand-held, self-operable acupuncture device of this type. See also U.S. Pat. No. 4,556,064 to Pomeranz et al.

U.S. Pat. No. 4,180,079 to Wing also discloses a hand-held, self-operable acupuncture device which applies an electrical pulse to selected portions of the skin. A probe terminating in a wad of cotton is the active electrode and the instrument case is the other electrode, whereby current flows from the probe and in a return path through the body and the hand that is holding the instrument, to the instrument case, so as to complete the circuit. However, the entire case is electrically conductive which is not desirable.

However, none of the above-described devices disclose any manner of locating the acupuncture points. This is accomplished generally by charts that are studied by the acupuncturist.

In U.S. Pat. No. 3,900,020 to Lock, there is disclosed an electronic acupuncture device which can be used with either needles or probes, and which includes a separate probe for locating the desired acupuncture points on the patient's body. The probe is passed over the patient's body, and an acupuncture point is located by noting sharp movements in the readings of the meters on the control panel. There is also a discussion of converting increases in current through the point finder probe into an audio signal. The probe is in two parts, a first part held by the physician and passed over the patient's body, and a second probe held by the patient. It is apparent, however, that such a system could not be used as a hand-held, self-operable acupuncture device by the patient. Further, there are separate probes and probe sockets in the control panel for supplying the therapeutic acupuncture current, in addition to different circuitry, thereby increasing the cost and complexity of the device.

OBJECTS AND SUMMARY OF THE INVENTION

Accordingly, it is an object of the present invention to provide an electronic acupuncture device that overcomes the aforementioned problems with the prior art.

It is another object of the present invention to provide an electronic acupuncture device that can be hand-held and self-operable by the patient.

It is still another object of the present invention to provide an electronic acupuncture device which can also locate the desired acupuncture points.

It is yet another object of the present invention to provide an electronic acupuncture device in which the probe used to locate the desired acupuncture points is the same probe used to apply the therapeutic acupuncture current, and wherein common circuitry is utilized.

It is a further object of the present invention to provide an electronic acupuncture device in which contact members on the casing, when touched by the user, complete the circuit through the user's body in order to apply the different currents.

It is a still further object of the present invention to provide an electronic acupuncture device in which the probe is formed by a telescoping section biased out of the casing, to protect the user and probe during operation of the device.

It is a yet further object of the present invention to provide an electronic acupuncture device that can provide therapeutic current directly through the probe or indirectly through contact members on the casing and then through the body of the user.

It is another object of the present invention to provide an electronic acupuncture device that is easy and economical to manufacture and use.

In accordance with an aspect of the present invention, an electronic acupuncture device includes a hand-holdable casing having an outer surface; probe means for supplying current to the skin of a person, the probe means extending from the casing; locating current supply means for supplying an alternating locating current to the probe means; therapeutic current supply means for supplying an alternating therapeutic current to the probe means; switch means for selectively supplying the locating current or the therapeutic current to the probe means; and contact member means on the outer surface of the casing for completing an electrical circuit of the device when the person is in contact with the contact member means so as to provide a return path for the locating current and the therapeutic current.

In accordance with another aspect of the present invention, an electronic acupuncture device includes a hand-holdable casing having an outer surface; probe means for supplying current to the skin of a person, the probe means extending from the casing and being movable with respect to the casing in an axial direction of the probe means; biasing means for biasing the probe means out of the casing; and current supply means for supplying current to the probe means.

In accordance with still another aspect of the present invention, an electronic acupuncture device includes a hand-holdable casing having an outer surface; probe means for supplying current to the skin of a person, the probe means extending from the casing; current supply means for supplying current to the probe means; switch means for selectively supplying the locating current or the therapeutic current to the probe means; contact member means on the outer surface of the casing for completing an electrical circuit of the device when the person is in contact with the contact member means so as to provide a return path for the locating current and the therapeutic current; and switch control means for controlling the switch means to selectively supply the therapeutic current to the probe means by any of the following routes: (i) directly to the probe means, and (ii) indirectly to the probe means through the contact member means and the body of the user.

In accordance with yet another aspect of the present invention, an electronic acupuncture device including a hand-holdable casing having an outer surface; probe means for supplying current to the skin of a person, the probe means extending from the casing and movable with respect to the casing in an axial direction of the probe means; biasing means for biasing the probe means out of the casing; locating current supply means for supplying a locating current to the probe means; therapeutic current supply means for supplying a therapeutic current to the probe means; switch means for selectively supplying the locating current or the therapeutic current to the probe means; contact member means on the outer surface of the casing for completing an electrical circuit of the device when the person is in contact with the contact member means so as to provide a return path for the locating current and the therapeutic current; and switch control means for controlling the switch means to selectively supply the therapeutic current to the probe means by any of the following routes: (i) directly to the probe means, and (ii) indirectly to the probe means through the contact member means and the body of the user.

The above and other objects, features and advantages of the present invention will become readily apparent from the following detailed description which is to be read in connection with the accompanying drawings.

DETAILED DESCRIPTION OF THE PREFERRED EMBODIMENTS

Figure 1:
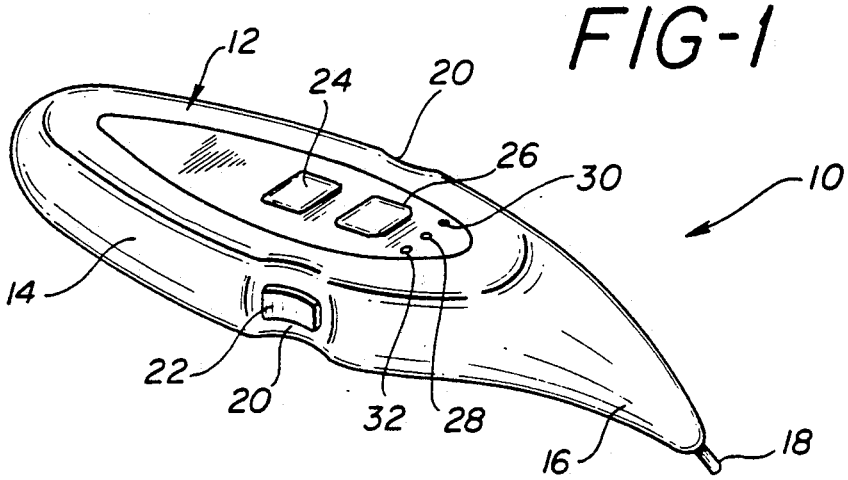
FIG. 1 is a perspective view of an electronic acupuncture device according to an embodiment of the present invention.
Figure 2:
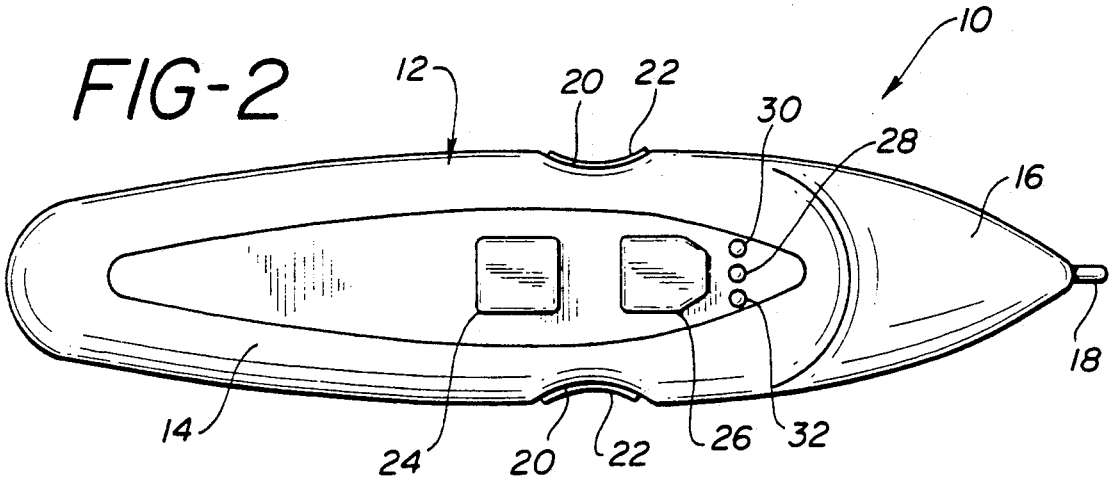
FIG. 2 is a top plan view of the electronic acupuncture device of FIG. 1.

Referring to the drawings in detail, and initially to FIGS. 1 and 2 thereof, an electronic acupuncture device 10 according to the present invention includes a plastic casing 12 which can be held in the hand of the user. In this regard, casing 12 has a slim, generally oblong portion 14 with a tapered, bent nose section 16. A probe 18 extends from the end of nose section 16 and is adapted to contact the skin of the user to both locate the desired acupuncture points and to apply therapeutic acupuncture current thereto. Probe 18 extends to the interior of casing 12 and is electrically connected with the circuitry therein.

Generally oblong portion 14 of casing 12 is provided with two indented or recessed sections 20 at opposite sides thereof, which are adapted to receive the thumb and forefinger of the user during operation. A conductive contact member 22 is provided in each recessed section 20, and opposite ends of each contact member 22 extend to the interior of casing 12 through slots therein so as to electrically connect each contact member 22 with the circuitry within casing 12. In accordance with the present invention, when acupuncture device is turned on, current will only flow through probe 18 when the user is also in contact with at least one contact member 22. In other words, by touching at least one contact member 22 during the operation, the user completes the electrical circuit from the internal circuitry within casing 12, to probe 18, through the user, to contact members 22 and back to the electrical circuitry within casing 12. As will be described hereinafter, such current can also move in the opposite direction in a different mode of operation, that is, from the electrical circuitry, to contact members 22, through the user, to probe 18 and back to the electrical circuitry.

Further, the upper surface of generally oblong portion 14 is provided with an ON/OFF button 24 for turning acupuncture device 10 on and off. A mode button 26 is also provided for determining the mode of operation, for example, a search mode for locating the acupuncture points or a therapeutic mode, and also for determining the type of current to be supplied during the therapeutic mode. Three light emitting devices (LEDs) 28, 30 and 32 are also visible through the upper surface of generally oblong portion 14 for indicating the mode and the type of current being supplied during the therapeutic mode.

Generally, in accordance with the present invention, there are three different modes. In the search mode, a low level alternating current in the form of a square wave signal having a fixed frequency, is supplied to probe 18 as probe 18 scans the skin surface of the user. It will be appreciated that probe 18 must be in contact with the skin during this scanning operation. The second mode is the tone mode, which is one of the two therapeutic modes. The tone mode is used, for example, to remove wrinkles, to tone up muscles prior to exercising and the like. In the tone mode, a constant alternating current having a square wave profile is supplied to probe 18. It will be appreciated that the current level in the tone mode is greater than that used in the search mode. Further, the level of current that is supplied to probe 18 will, of course, depend on the body part with which probe 18 is in contact. For example, facial areas will generally require less current than torso areas. The frequency of the signal is constant. The level of the current is preferably in the range of 2 to 200 μA. Preferably, the current level is further reduced within the range of 20 to 100 μA, and more preferably, is 40 or 50 μA. Further, in this mode, current is supplied from contact members 20, through the body and back to probe 18. In such case, a negative amplitude current is supplied, for example, between 0 and −9 volts.

The third mode is the relax mode, which is the other therapeutic mode. The relax mode is used, for example, to relax muscles after exercising and to block pain. In this mode, the same current is supplied, except that the current flows from probe 18, through the body and back to contact members 22. In such case, an effective current in the range of 0 to +9 volts is applied to the skin.

In basic operation, acupuncture device 10 is first turned on by depressing button 24. At this time, device 10 is automatically in the search mode, and accordingly, LED 28 is lit. LED 28 preferably emits a red light. The user grasps device 10 by contact members 22, places probe 18 on his or her skin, and moves probe 18 over the skin. At this time, device 10 will emit a pitched sound which also indicates the acupuncture device 10 is operational and in the search mode. When an acupuncture point is located by probe 18, a different pitch sound will be emitted to indicate the location of the acupuncture point. Then button 26 is depressed, which changes over the search mode to the tone mode. At the same time, the pitched sound terminates, LED 28 is turned off, and LED 30 is turned on to emit a green light. The tone current is then supplied as indicated above. If the user wants to enter the relax mode, it is only necessary to once again depress the button 26, whereupon LED 30 turns off and LED 32 turns on to emit an amber light. Relax current is then supplied as indicated above. Continued depression of button 26 will toggle between the tone mode and the relax mode. In order to return to the search mode, it is necessary to depress button 24 which will turn off acupuncture device 10, and then depress button 24 again to once again start the above operation.

Figure 3:
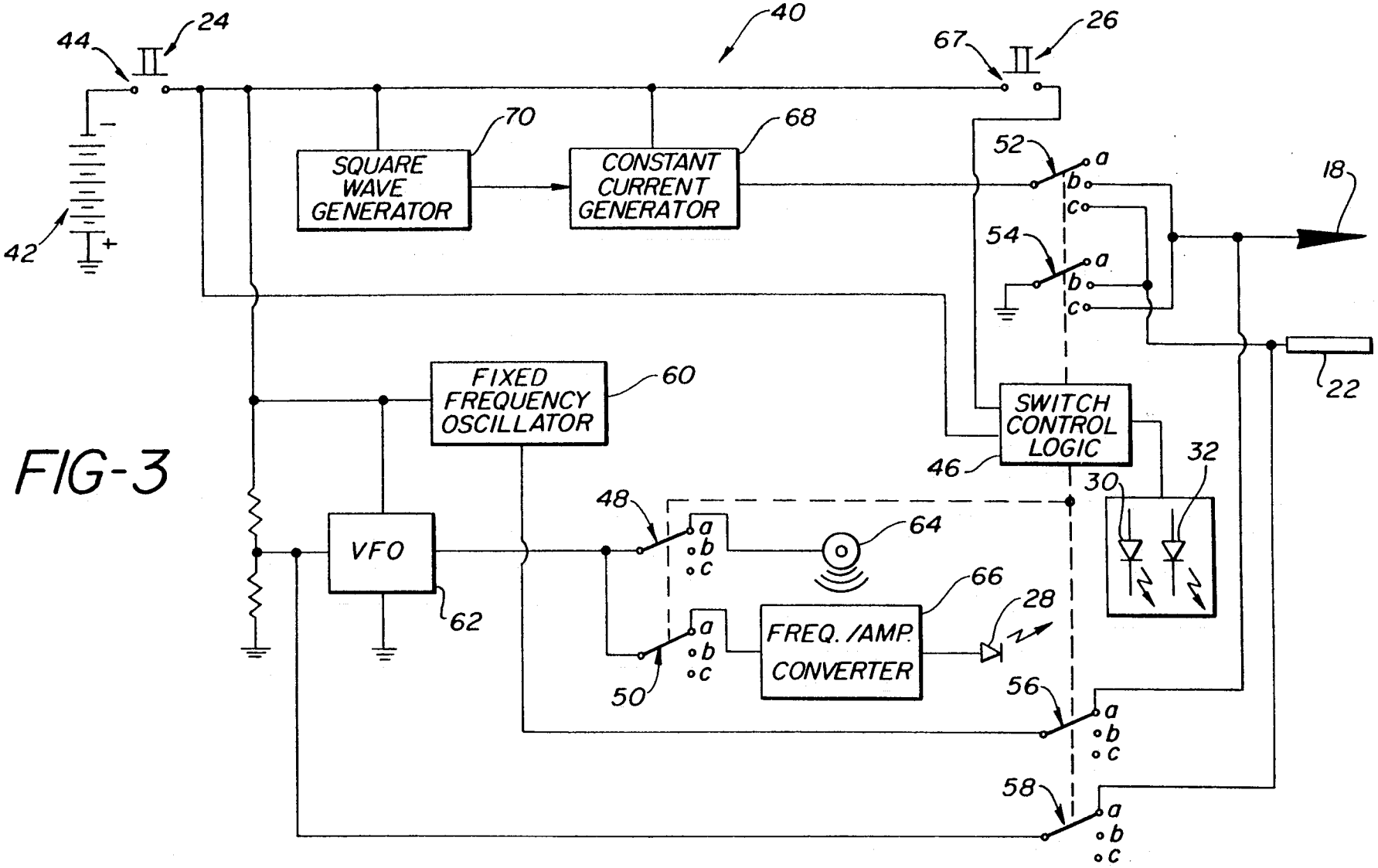
FIG. 3 is a block diagram of circuitry according to one embodiment of the present invention for use with the electronic acupuncture device of FIG. 1.

Referring now to FIG. 3, circuitry 40 according to one embodiment of the invention for use in acupuncture device 10, will now be described. As shown, a power supply 42, such as a standard 9 volt battery, is connected to an ON/OFF switch 44 which is activated by button 24. Thus, when button 24 is depressed, power supply 42 is connected with the remainder of the circuitry to turn on acupuncture device 10. At this time, power is supplied to switch control logic circuit 46. Switch control logic circuit 46 controls the operation of ganged single-pole triple-throw switches 48, 50, 52, 54, 56 and 58 so that, when device 10 is first turned on, all of these switches have their movable arms connected with fixed terminal a thereof, corresponding to the search mode.

Further, power is supplied through switch 44 to a fixed frequency oscillator 60 and a variable frequency oscillator (VFO) 62. Accordingly, fixed frequency oscillator supplies a fixed frequency, low level, square wave oscillation signal through switch 56 to probe 18. When the user is in contact with contact members 22, a closed electrical path is proved, and the current supplied through probe 18, travels through the body of the user and back to contact members 22. From there, the return current travels through switch 58 to the input of VFO 62.

During this current supply through probe 18, VFO 62 supplies an oscillation signal in the range of 450 Hz to 2.3 kHz to an audible generator, such as a buzzer 64, through switch 48, and accordingly, buzzer 64 emits a sound at a pitch determined by the frequency of the square wave signal oscillation signal from VFO 62. However, when probe 18 passes over an acupuncture point, the resistance of the skin changes, and accordingly, the signal back to VFO through switch 58 also changes. As a result, the output frequency of the oscillation signal from VFO 62 is varied. This, in turn, results in a different pitch sound from buzzer 64 to indicate to the user that an acupuncture point has been located. At the same time, VFO supplies a signal to a frequency/amplitude converter 66 through switch 50. Frequency/amplitude converter 66 converts the change in frequency of the output signal from VFO 62 to a change in amplitude, and supplies an output signal to LED 28 to cause LED to emit a red light, the intensity thereof depending upon the change in frequency of the output signal from VFO 62.

When the desired acupuncture point is located, the user then depresses button 26, which closes a switch 67, and thereby connects the power supply 42 to another input of switch control logic circuit 46. As a result, switch control logic circuit 46 changes over the movable arms of switches 48, 50, 52, 54, 56 and 58 to fixed terminal c thereof, corresponding to the tone mode. In this position, fixed frequency oscillator 60 and VFO 62 are disconnected from probe 18. However, an alternating constant current is supplied to contact members 22 from a constant current generator 68 through switch 52. Constant current generator 68 has an input connected with a square wave generator 70, such that the constant current supplied to probe 18 is an alternating square wave current. The frequency of the signal from square wave generator 70 is constant and is preferably 58 Hz, while the constant current from generator 68 preferably has a current amplitude in the range of 2 to 200 μA and with the voltage varying in a square wave manner between 0 to −9 volts. Preferably, the current level is further reduced within the range of 20 to 100 μA, and more preferably, is 40 or 50 μA. Therefore, in this mode, current is supplied from contact member 22, through the body and back to probe 18. From probe 18, the signal is supplied through switch 54 to ground. At the same time, switch control logic circuit 46 supplies a signal to activate LED 30 to emit a green light.

If it is desired to operate in the relax mode, button 26 is again depressed, so as to supply another signal to switch control logic circuit 46. As a result, the movable arms of switches 48, 50, 52, 54, 56 and 58 are moved into contact with fixed terminal b thereof. As such, the constant current from constant current generator 68 is supplied through switch 52 to probe 18. From probe 18, the current travels through the body and back to contact members 22, where it is supplied to ground through switch 54.

It will therefore be appreciated that, as so far described, a novel hand-held, self-operable acupuncture device 10 is provided in which the same probe 18 used to deliver the therapeutic current to the acupuncture points in the tone and relax modes, is also used to locate the desired acupuncture points in the search mode. Further, completion of the circuit is accomplished by means of the user holding acupuncture device 10 so as to be in contact with at least one contact member 22 on the side thereof, rather than providing that the entire casing 12 is conductive, which is disadvantageous.

Figure 4:
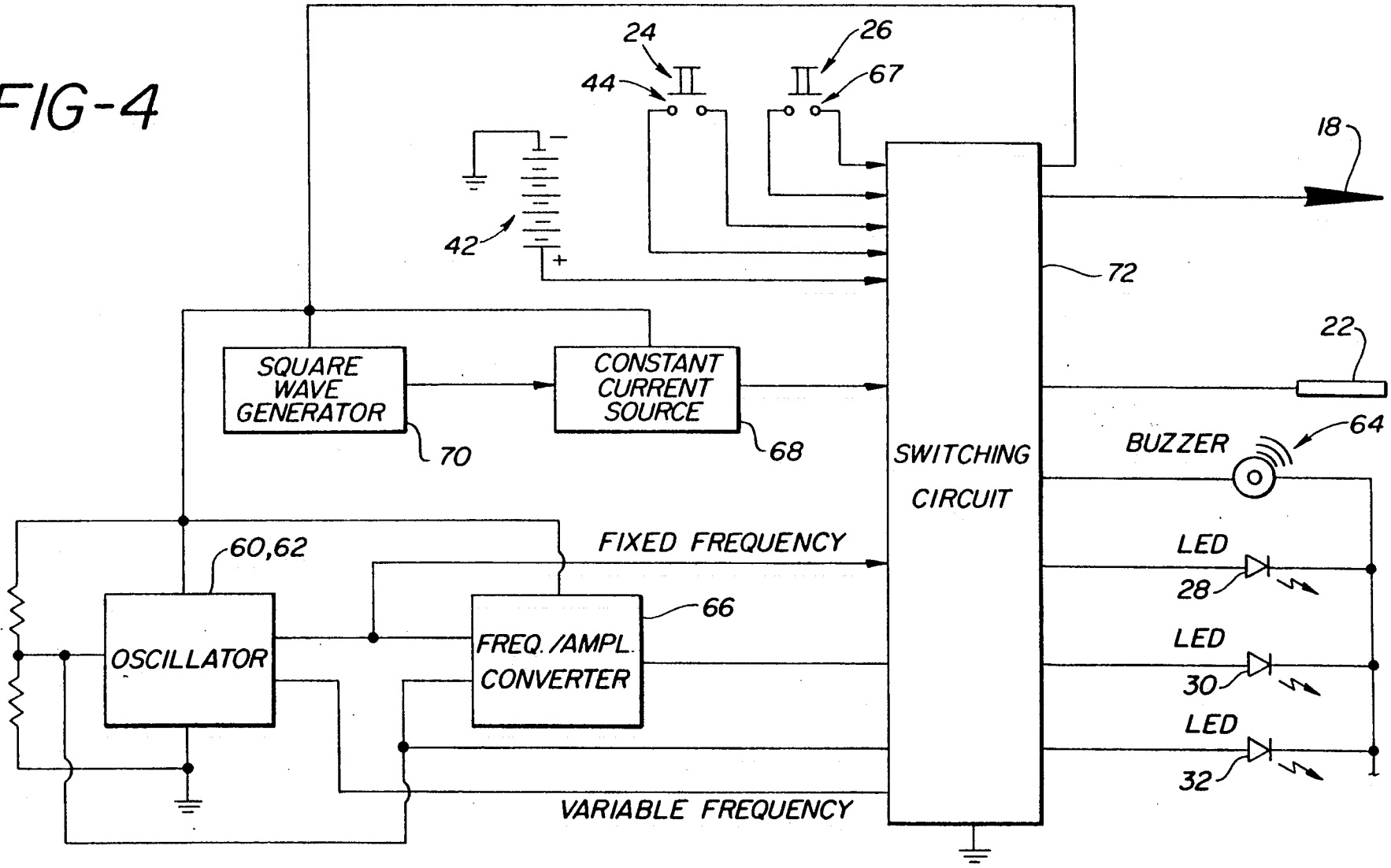
FIG. 4 is a block diagram of circuitry according to another embodiment of the present invention for use with the electronic acupuncture device of FIG. 1.

It will further be appreciated that, although single-pole, triple-throw switches have been described, the same results can be achieved with semiconductor switching devices in place thereof, or other suitable switching circuitry. In this regard, reference is now made to FIG. 4, which shows circuitry according to another embodiment of the invention which uses an electronic switch circuit 72 in place of the single-pole, triple-throw switches described above. In FIG. 4, the same elements are represented by the same reference numerals, and a detailed description thereof is omitted herein for the sake of brevity. Further, in FIG. 4, fixed frequency oscillator 60 and variable frequency oscillator 62 are shown combined into a single box for the sake of brevity.

Figure 5:
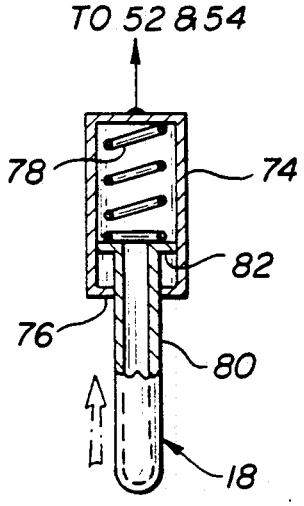
FIG. 5 is a cross-sectional view of the probe of the electronic acupuncture device of FIG. 1.

In accordance with another aspect of the present invention, probe 18 is spring biased outwardly in order to prevent injury to the user during the operation when the user is moving probe 18 across the skin. Specifically, as shown in FIG. 5, a conductive cylinder 74 is electrically connected with fixed terminal b of switch 52 and fixed terminal c of switch 54, as shown in FIG. 3. Cylinder 74 has an inwardly turned annular flange 76 at the free end thereof, and a coil spring 78 is housed within cylinder 74. Probe 18 includes a cylindrical piston portion 80 slidably movable within cylinder 74 such that the outer walls of piston portion 80 are in sliding wiper contact with the inner surface of flange 76. As a result, probe 18 is electrically connected with terminal b of switch 52 and terminal c of switch 54. The inner end of piston portion 80 is formed with an outwardly directed annular flange 82, also in sliding wiper contact with the inner wall of cylinder 74, and which prevents escape of probe 18 from cylinder 74. Accordingly, if the user applies greater pressure on probe 18, probe 18 retracts within cylinder 74 so as to prevent injury to the user and so as to prevent damage to probe 18.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. An electronic acupuncture device comprising:

a hand-holdable casing having a non-conducting outer surface and a conducting inner surface;

probe means for supplying current to the skin of a person, said probe means extending from said casing and being movable with respect to said casing in an axial direction of said probe means, said probe means being in sliding electrical contact with said inner surface of said casing;

biasing means for biasing said probe means out of said casing; and current supply means for supplying current to said probe means through said conducting inner surface of said casing.

2. An electronic acupuncture device according to claim 1, wherein said biasing means includes a coil spring for biasing said probe means out of said casing.

3. An electronic acupuncture device according to claim 2, wherein said casing includes a cylinder having said conductive inner surface, said probe means being telescopically received in said cylinder in sliding electrical contact with said inner surface, and said coil spring biases said probe means out of said cylinder.

4. An electronic acupuncture device comprising:

a hand-holdable casing having a non-conducting outer surface and a conducting inner surface;

probe means for supplying current to the skin of a person, said probe means extending from said casing and being movable with respect to said casing in an axial direction of said probe means, said probe means being in sliding electrical contact with said inner surface of said casing;

biasing means for biasing said probe means out of said casing;

locating current supply means for supplying a locating current to said probe means;

therapeutic constant current supply means for supplying an alternating therapeutic constant current through said probe means and through the skin of the person such that said therapeutic current remains constant regardless of the electrical resistance of the skin of the person;

switch means for selectively supplying said locating current or said therapeutic constant current through said probe means;

contact member means on the outer surface of said casing for completing an electrical circuit of said device when the person is in contact with said contact member means so as to provide a return path for said locating current and said therapeutic constant current; and switch control means for controlling said switch means to selectively supply said therapeutic constant current through said probe means by any of the following routes:

(i) directly to said probe means, and (ii) indirectly to said probe means through said contact member means and the body of the user.

5. An electronic acupuncture device according to claim 4, wherein said locating current supply means includes oscillator means for supplying an alternating locating current with a fixed frequency to said probe means.

6. An electronic acupuncture device according to claim 5, further including signal means for indicating the location of an acupuncture point by said probe means.

7. An electronic acupuncture device according to claim 6, wherein said signal means includes variable frequency oscillator means, for producing a variable frequency oscillation signal, said variable frequency oscillation means having an input connected with said contact member means, and audible alarm means connected with an output of said variable frequency oscillation means for producing an audible signal in response to a change in frequency of a return current from said contact member means to said variable frequency oscillation means.

8. An electronic acupuncture device according to claim 6, wherein said signal means includes variable frequency oscillator means for producing a variable frequency oscillation signal, said variable frequency oscillation means having an input connected with said contact member means, and visual means connected with an output of said variable frequency oscillation means for producing a visual signal in response to a change in frequency of a return current from said contact member means to said variable frequency oscillation means.

9. An electronic acupuncture device according to claim 4, wherein said therapeutic current supply means includes a constant current generator for supplying said therapeutic current, and a square wave generator for controlling said constant current generator to supply said therapeutic current as an alternating current.

10. An electronic acupuncture device according to claim 4, further including light emitting means for indicating when said probe means is supplied with said locating current and when said probe means is supplied with said therapeutic current.

11. An electronic acupuncture device according to claim 4, wherein said biasing means includes a coil spring for biasing said probe means out of said casing.

12. An acupuncture device according to claim 11, wherein said casing includes a cylinder having said conductive inner surface, said probe means being telescopically received in said cylinder in sliding electrical contact with said inner surface, and said coil spring biases said probe means out of said cylinder.

* * * * *